US009074465B2

(12) United States Patent
Abivin et al.

(10) Patent No.: US 9,074,465 B2
(45) Date of Patent: Jul. 7, 2015

(54) METHODS FOR ALLOCATING COMMINGLED OIL PRODUCTION

(75) Inventors: Patrice Abivin, Edmonton (CA); Michael M Toribio, Edmonton (CA); Kentaro Indo, Edmonton (CA)

(73) Assignee: Schlumberger Technology Corporation, Cambridge, MA (US)

( * ) Notice: Subject to any disclaimer, the term of this patent is extended or adjusted under 35 U.S.C. 154(b) by 948 days.

(21) Appl. No.: 12/642,299

(22) Filed: Dec. 18, 2009

(65) Prior Publication Data

US 2010/0307740 A1 Dec. 9, 2010

Related U.S. Application Data

(63) Continuation-in-part of application No. 12/477,190, filed on Jun. 3, 2009, now abandoned.

(51) Int. Cl.
*E21B 43/14* (2006.01)
*E21B 47/00* (2012.01)

(52) U.S. Cl.
CPC ..... *E21B 43/14* (2013.01); *E21B 47/00* (2013.01)

(58) Field of Classification Search
CPC ..... G01N 33/2823; E21B 49/08; E21B 49/10; E21B 2049/085; E21B 47/00
USPC ..... 73/61.43–61.79; 166/75.12, 264, 369, 166/336
See application file for complete search history.

(56) References Cited

U.S. PATENT DOCUMENTS 3,239,666 A * 3/1966 Newton et al. ..... 250/255
3,633,667 A 1/1972 Falkner, Jr.
4,990,250 A * 2/1991 Hellinger ..... 210/198.2

(Continued)

FOREIGN PATENT DOCUMENTS

EP 1975498 10/2008
GB 2359631 A 8/2001

(Continued)

OTHER PUBLICATIONS

R. Akkurt, et al, "Focusing on Downhole Fluid Sampling and Analysis", SLB Oilfield Review, Jan. 1, 2007, pp. 4-19, XP002633163.

(Continued)

*Primary Examiner* — Shane Bomar
*Assistant Examiner* — Kipp Wallace
(74) *Attorney, Agent, or Firm* — Cathy Hewitt; Kenneth L. Kincaid

(57) ABSTRACT

Methods and related systems are described for real-time wellsite production allocation analysis. Spectroscopic in-situ measurements are made in the vicinity of a wellsite of a produced fluid from one or more boreholes. The produced fluid includes in a co-mingled state, at least a first fluid component from a first production zone and a second fluid component from a second production zone. An allocation is estimated in real-time for at least the first fluid component in the produced fluid based at least in part on the spectroscopic in-situ measurements. The in-situ measurements can be several types, for example: (1) absorption of electromagnetic radiation having wavelengths in the range of ultraviolet, visible and/or infrared light, (2) X-ray fluorescence spectroscopy measurements, (3) electromagnetic scattering spectroscopic measurements such as Raman spectroscopy measurements, (4) NMR spectroscopy measurements, and (5) terahertz time-domain spectroscopy measurements.

24 Claims, 7 Drawing Sheets

(56) References Cited

U.S. PATENT DOCUMENTS

| | | | | |
|---|---|---|---|---|
| 5,067,616 | A * | 11/1991 | Plester et al. | 209/3.1 |
| 5,189,919 | A | 3/1993 | Hernandez | |
| 6,343,507 | B1 * | 2/2002 | Felling et al. | 73/152.19 |
| 6,435,279 | B1 | 8/2002 | Howe et al. | |
| 7,032,658 | B2 | 4/2006 | Chitwood et al. | |
| 7,083,009 | B2 | 8/2006 | Paluch et al. | |
| 7,219,740 | B2 | 5/2007 | Saucier | |
| 7,231,819 | B2 * | 6/2007 | Jones et al. | 73/152.23 |
| 7,311,151 | B2 | 12/2007 | Chitwood et al. | |
| 7,464,755 | B2 | 12/2008 | Edwards | |
| 7,616,316 | B1 * | 11/2009 | Silver et al. | 356/437 |
| 2004/0134662 | A1 | 7/2004 | Chitwood et al. | |
| 2004/0244982 | A1 | 12/2004 | Chitwood et al. | |
| 2005/0028973 | A1 | 2/2005 | Moody et al. | |
| 2005/0028974 | A1 | 2/2005 | Moody | |
| 2005/0268702 | A1 * | 12/2005 | Johansen | 73/61.45 |
| 2006/0108120 | A1 | 5/2006 | Saucier | |
| 2006/0118308 | A1 | 6/2006 | Saucier | |
| 2006/0154306 | A1 | 7/2006 | Kotlar et al. | |
| 2006/0155474 | A1 * | 7/2006 | Venkataramanan et al. | 702/13 |
| 2006/0272727 | A1 | 12/2006 | Dinon et al. | |
| 2007/0168170 | A1 | 7/2007 | Thomas | |
| 2007/0183928 | A1 * | 8/2007 | Neyer et al. | 422/70 |
| 2007/0284108 | A1 | 12/2007 | Roes | |
| 2007/0289733 | A1 | 12/2007 | Hinson et al. | |
| 2008/0017380 | A1 | 1/2008 | Vinegar et al. | |
| 2008/0035347 | A1 | 2/2008 | Brady et al. | |
| 2008/0035348 | A1 | 2/2008 | Vitek et al. | |
| 2008/0135239 | A1 | 6/2008 | Edwards | |
| 2008/0135244 | A1 | 6/2008 | Miller | |
| 2008/0135254 | A1 | 6/2008 | Vinegar et al. | |
| 2008/0142217 | A1 | 6/2008 | Pieterson et al. | |
| 2008/0149343 | A1 | 6/2008 | Chitwood et al. | |
| 2008/0165364 | A1 * | 7/2008 | Zhao et al. | 356/451 |
| 2008/0173444 | A1 | 7/2008 | Stone et al. | |
| 2008/0173449 | A1 | 7/2008 | Fowler | |
| 2008/0173450 | A1 | 7/2008 | Goldberg et al. | |
| 2008/0174115 | A1 | 7/2008 | Lambirth | |
| 2008/0185147 | A1 | 8/2008 | Vinegar et al. | |
| 2008/0217003 | A1 | 9/2008 | Kuhlman et al. | |
| 2008/0217004 | A1 | 9/2008 | DeRouffignac | |
| 2008/0217015 | A1 | 9/2008 | Vinegar et al. | |
| 2009/0025460 | A1 * | 1/2009 | Hurmuzlu et al. | 73/61.45 |

FOREIGN PATENT DOCUMENTS

| | | | |
|---|---|---|---|
| GB | 2376035 | A | 12/2002 |
| GB | 2404679 | A | 2/2005 |
| GB | 2405652 | A | 3/2005 |
| GB | 2460668 | A | 12/2009 |
| WO | 2003048240 | A2 | 6/2003 |
| WO | 2003048240 | A3 | 2/2004 |
| WO | 2004053935 | A2 | 6/2004 |
| WO | 2004053935 | A3 | 8/2004 |
| WO | 2004083595 | A2 | 9/2004 |
| WO | 2006057995 | A2 | 6/2006 |
| WO | 2006057996 | A2 | 6/2006 |
| WO | 2006057995 | A3 | 12/2006 |
| WO | 2006057996 | A3 | 1/2007 |
| WO | 2004083595 | A3 | 4/2007 |
| WO | 2007084348 | | 7/2007 |
| WO | 2008002345 | A2 | 1/2008 |
| WO | 2008051299 | A2 | 5/2008 |
| WO | 2008064074 | | 5/2008 |

OTHER PUBLICATIONS

Bazan, L.W., "The Allocation of Gas Well Production Data Using Isotope Analysis", SPE 40032, Gas Technology Symposium, Calgary, Alberta, Canada, Mar. 1998.

Hwang, et al, "Allocation of Commingled Pipeline Oils to Field Production", Organic Geochemistry, vol. 31 pp. 1463-1474, 2000.

Kaufman, et al, "Gas Chromatography as a Development and Production Tool for Fingerprinting Oils from Individual Reservoirs: Application to the Gulf of Mexico". GCSSEPM Foundation Ninth Annual Research Conference Proceedings, Oct. 1, 1990, pp. 263-282.

Kaufman, et al, "A New Technique for the Analysis of Commingled Oils and its Application to Production Allocation Calculations", Organic Geochemistry, vol. 31, pp. 1463-1474, 2000.

McCaffrey, et al, "Using Biomarkers to Improve Heavy Oil Reservoir Management: An Example from the Cymric Field Kern Count", California AAPG Bulletin, vol. 80 No. 6 pp. 898-913, Jun. 1996.

Milkov, et al, "Compartmentalization and Time-lapse Geochemical Reservoir Surveillance of the Horn Mountain Oil Field, Deep-water Gulf of Mexico", AAPG Bulletin vol. 91 No. 6 pp. 847-876.

Nengkoda, et al, "The Effectiveness of Geochemical Technique for Evaluation of Commingled Reservoir: A Case Study", SPE 109169, Asia Pacific Oil & Gas Conference and Exhibition, Jakarta, Indonesia, Nov. 2007.

Pasadakis, et al, "Method Measures Commingled Production, Pipeline Components", Oil & Gas Journal pp. 46-47, Jan 3, 2000.

Peters and Fowler, "Application of Petroleum Geochemistry to Exploration and Reservoir Management", Organic Geochemistry, vol. 33, pp. 5-36, 2002.

Reyes, "Crude Oil Fingerprinting by the Total Scanning Fluorescence Technique", SPE 2694 1993 Eastern Regional Conference & Exhibition 1993.

Wen et al, "The Application of Gas Chromatography Fingerprint Technique in Calculating Oil Production Allocation of Single Layer in the Commingled Well", Chinese Journal of Geochemistry, vol. 24 No. 3, 2005.

* cited by examiner

METHODS FOR ALLOCATING COMMINGLED OIL PRODUCTION

CROSS REFERENCE TO RELATED APPLICATION

This patent application is a continuation-in-part of U.S. application Ser. No. 12/477,190 filed Jun. 3, 2009 which is incorporated by reference herein.

BACKGROUND

1. Field

This patent specification relates to allocating commingled oil production. More particularly, this patent specification relates to methods and systems for allocating commingled oil production in real-time based on measurements made at or near the wellsite.

2. Background

Commingling is a common practice in the oil industry for sharing facilities and equipment to reduce costs. Examples of commingling include: producing two or more reservoirs through a single tubing string, mixing gas/oil/water from several wells in a single separator tank, and using a single pipeline for transporting production from several fields. Crude oils originating from different producing zones, wells, platforms or fields are mixed through commingling operations. See, Hwang R. J., Baskin D. K., Teerman S. C., *Allocation of commingled pipeline oils to field production*, Organic Geochemistry, vol. 31 pp 1463-1474, 2000 (hereinafter "Hwang et al., 2000").

There are several reasons that accurate assessment of the individual field contributions may be desirable or necessary. For example, it may be desirable to have an accurate assessment of the amount of producible oil or gas (See, Peters K. E., Fowler M. G., *Application of Petroleum Geochemistry to Exploration and Reservoir Management*, Organic Geochemistry, vol. 33, pp 5-36, 2002), and to effectively plan future directions, so as to avoid costly exploration failures (See, International Patent Application No. WO 2008/002345). Another example is the matching of current allocation data with historical data to assess production and plan remedial operations on the well (e.g. pipeline leaks, cement bond failures, non productive zones), to use in a workflow leading to critical management and investment decisions (See, International Patent Application No. WO 2008/002345; and Kaufman R. L., Ahmed A. S., Hempkins W. B., *A New Technique for the Analysis of Commingled Oils and its Application to Production Allocation Calculations*, Organic Geochemistry vol. 31 pp 1463-1474, 2000 (hereinafter "Kaufmann et al. 1990")). Finally, petroleum sales value and tax dues often depends on the quality of oil, varying ownership and tax regimes among different zones or neighboring fields (Hwang et al., 2000).

Back-allocation of commingled production or transport is conventionally being carried out though wireline logging (e.g. Production Logging Tool (PLT), Reservoir Sampling with MDT/DST), and production metering coupled with modeling and simulation. Recently, gas chromatographic analysis coupled with matrix mathematics has been employed to back allocate commingled pipeline crude from multiple contributing fields. In most cases, the use fluid geochemistry is used as an accompaniment to the more traditional techniques mentioned above.

Several studies discuss the potential of using gas chromatograms as a means of differentiating and allocating hydrocarbon fluids. For discussions of employing gas chromatography analysis to perform zonal and well-to-well allocation, see: Kaufmann et al. 1990, Bazan L. W., *The Allocation of Gas Well Production Data using Isotope Analysis*, SPE 40032, Gas Technology Symposium, Calgary, Canada, March 1998; Hwang et al 2000; Milkov A. V., Goebel E., Dzou L., Fisher D. A., Kutch A., McCaslin N., Bergman D. F., *Compartmentalization and Time-lapse Geochemical Reservoir Surveillance of the Horn Mountain oil field, Deep-water Gulf of Mexico*, AAPG Bulletin vol. 91, No 6 pp 847-876, 2007; Wen Z., Zhu D., Tang Y., Li Y., Zhang G., *The application of gas chromatography fingerprint technique in calculating oil production allocation of single layer in the commingled well*, Chinese Journal of Geochemistry, Vol. 24 No. 3, 2005; McCaffrey M. A., Legarre H. A., Johnson S. J., *Using Biomarkers to improve Heavy Oil Reservoir Management: An example from the Cymric field Kern Count, Calif.*, AAPG Bulletin, Vol. 80 No. 6 pp 898-913, June 1996; and Nengkoda A, Widojo S, Mandhari M. S., Hinai Z, *The Effectiveness of Geochemical Technique for Evaluation of Commingled Reservoir: A Case Study, SPE* 109169, Asia Pacific Oil & Gas Conference and Exhibition, Jakarta, Indonesia, November 2007.

However, such gas chromatography based analyses use relatively complex equipment located in a laboratory in a location remote from the wellsite. Therefore the results are delayed and can be affected by changes in and possible contamination of the sample during transportation. Furthermore, complex gas chromatographic techniques are inherently prone to human operator errors.

Reyes, M V. *Crude Oil Fingerprinting by the Total Scanning Fluorescence Technique*, SPE 26943, 1993, Eastern Regional Conference & Exhibition 1993, discusses an application of total scanning fluorescence for crude oil fingerprinting, but does not discuss applying the techniques to the problem of production allocation. The technique relies on the detection of wide range of poly-aromatic hydrocarbon compounds (PAH) as well as the mono-ring aromatics.

Pasadakis, N., Chamilaki E., Varotsis N., *Method measures commingled production, pipeline components*, Oil & Gas Journal pp 46-47, Jan. 3, 2000 discusses the use Fourier Transform-Infrared Spectroscopy in identifying volumetric cuts in a three-oil mixture sample. FT-IR analyses use differences in the IR oil spectra in the region of about 3,000 $cm^{-1}$. Relative to other methods, analysis requires less time with the quantitative determination absolute error was found to be less than 2%. The analysis seems to have been performed in a lab, and there is no suggestion that the process can be performed real-time or at the wellsite.

Permanyer A., Rebufa C., Kister J., *Reservoir compartmentalization assessment by using FTIR spectroscopy*, Journal of Petroleum Science & Engineering vol. 58 pp 464-471, 2007 Permanyer et al (2007), discusses, on the other hand, the application of FT-IR spectroscopy for reservoir compartmentalization assessment and stress the complementary benefits that the techniques provide to conventional GC analysis.

SUMMARY

According to some embodiments, a method for real-time wellsite production allocation analysis is provided. The method includes making spectroscopic in-situ measurements in the vicinity of a wellsite of a produced fluid from one or more boreholes. The produced fluid includes in a co-mingled state, at least a first fluid component from a first production zone and a second fluid component from a second production zone. An allocation is estimated in real-time for at least the first fluid component in the produced fluid based at least in part on the spectroscopic in-situ measurements.

The in-situ measurements can be several types, for example: (1) absorption of electromagnetic radiation having wavelengths in the range of ultraviolet, visible and/or infrared light, (2) X-ray fluorescence spectroscopy measurements, (3) electromagnetic scattering spectroscopic measurements such as Raman spectroscopy measurements, (4) NMR spectroscopy measurements, and (5) terahertz time-domain spectroscopy measurements. According to some embodiments, a plurality of spectroscopic measurement techniques are performed and the method determines which of the techniques will be used in the estimation.

Data from the measurements can be corrected prior to the estimation. For example, techniques such as aligning signals, removing baseline, and removing offset can be carried out. The allocation estimation can include an error-minimization process, a constrained linear least-squares technique and/or a singular value decomposition technique. The first fluid and the second fluid can be produced from different boreholes, or the same borehole. The wellsite can be a marine wellsite or a land wellsite.

According to some embodiments, a system is also provided for real-time wellsite production allocation analysis.

As used herein the term "real-time" means performed within a time frame such that a user can take appropriate action so as to alleviate potential problems. In the context of production allocation estimates at the wellsite, "real-time" means a range from a few seconds to several hours, and up to about 1 day from the time the fluid is produced or a sample of the fluid is gathered at the wellsite.

As used herein the term "in-situ" in the context of measurements of a fluid means the measurement is made of the fluid in the same place or vicinity as the fluid is sampled. This is in contrast to transporting a sample to another location such as a laboratory where a measurement is made.

By providing real time production allocation analyses trough in-situ wellsite measurements, an increased ability to respond quickly to identified problems can be provided. For example, if it is discovered real time that one zone is shut down, then remedial action can be taken very quickly. Additionally, by providing real time production allocation analyses trough in-situ wellsite measurements problems associated with sample contamination during transportation to a remote laboratory can be alleviated.

Further features and advantages will become more readily apparent from the following detailed description when taken in conjunction with the accompanying drawings.

BRIEF DESCRIPTION OF THE DRAWINGS

The present disclosure is further described in the detailed description which follows, in reference to the noted plurality of drawings by way of non-limiting examples of exemplary embodiments, in which like reference numerals represent similar parts throughout the several views of the drawings, and wherein.

DETAILED DESCRIPTION OF THE PREFERRED EMBODIMENTS

Figure 1:
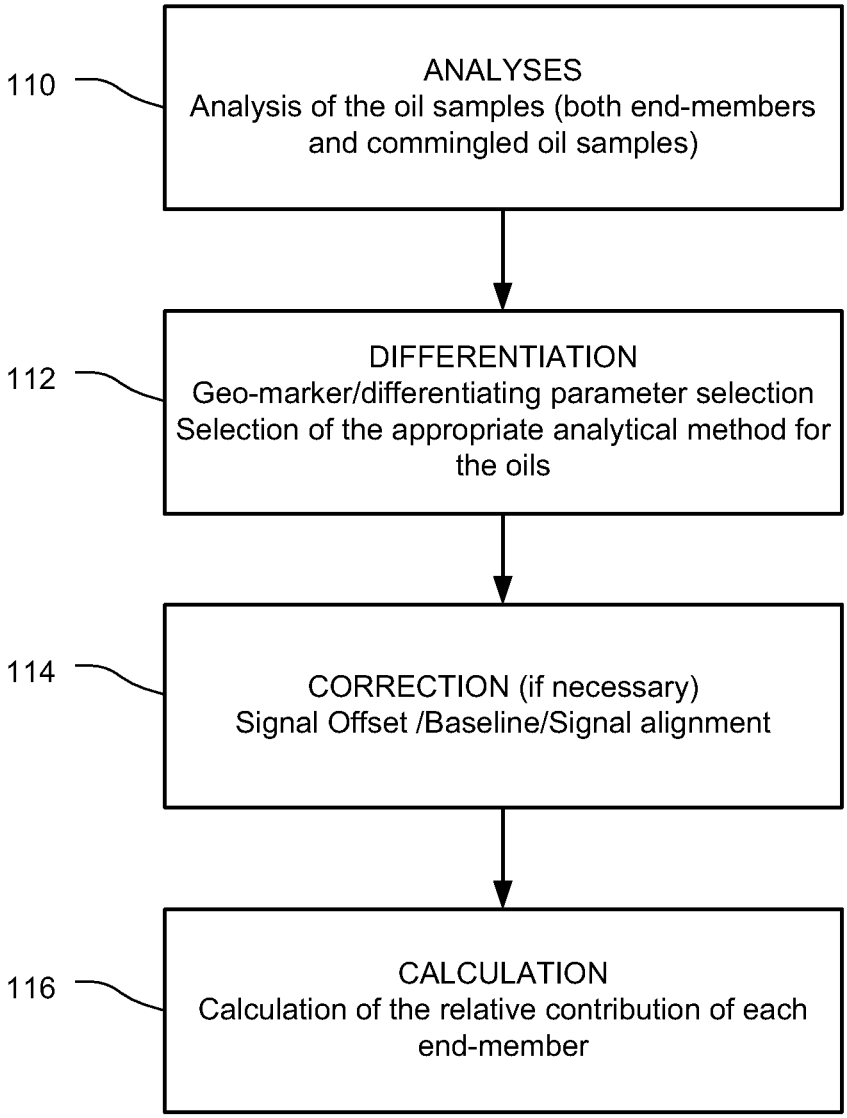
FIG. 1 is a flow chart showing steps in the allocation method, according to embodiments.

The following description provides exemplary embodiments only, and is not intended to limit the scope, applicability, or configuration of the disclosure. Rather, the following description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, systems, processes, and other elements in the invention may be shown as components in block diagram form in order not to obscure the embodiments in unnecessary detail. In other instances, well-known processes, structures, and techniques may be shown without unnecessary detail in order to avoid obscuring the embodiments. Further, like reference numbers and designations in the various drawings indicated like elements.

Also, it is noted that individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but could have additional steps not discussed or included in a figure. Furthermore, not all operations in any particularly described process may occur in all embodiments. A process may correspond to a method, a function, a procedure, a subroutine, a subprogram, etc. When a process corresponds to a function, its termination corresponds to a return of the function to the calling function or the main function.

Furthermore, embodiments of the invention may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

According to some embodiments, new techniques such as Near Infrared (NIR) Spectroscopy are used to analyze and differentiate oil samples. From the absorption spectra of both the pure end member and the commingled oil mixture, differentiating chemical component parameters are then selected and are used to quantify their relative contributions in a commingled oil mixture.

According to some embodiments, methods of back allocating commingled oil production use spectroscopic analysis to differentiate and back allocate commingled oil allocation. According to some embodiments, analysis techniques include: ultraviolet-visible-near infared (UV-Vis-NIR) spectroscopy, X-ray fluorescence spectroscopy, Raman spectroscopy, NMR spectroscopy, and terahertz spectroscopy.

FIG. 1 is a flow chart showing steps in the allocation method, according to embodiments. In step 110, the samples are analyzed. Corresponding spectral analysis on the end-members and the commingled oil are collected.

In step 112, the analytical results are interpreted. This interpretation leads to the selection of the data that are used. For example, in some cases the total signal is used. In other cases, only part of the signal is used so as to focus on the most differentiating part of the signal reflecting, for instance, a certain fraction of the oils. According to some embodiments, this step is also used to determine which of the available analytical techniques available is the most suitable for the particular application. According to some embodiments, a multivariate analysis technique such as principal component analysis (PCA) is used to differentiate the oils.

In step 114, the data is corrected prior to treatment. Baseline removal, signal scale correction and alignment are examples of ways to limit errors/uncertainties, while making the data easily comparable. According to some embodiments, offsets are removed by adding a fictive end-member. According to some other embodiments, the derivative of the signal is used to enhance the features of the signal. According to some embodiments, no correction of the data is used for some applications.

In step 116, calculations are performed using constrained linear least-squares, singular value decomposition or any error-minimization process. The system to solve is $G \cdot x = d$, where G is the n-by-m-matrix constituted of end-members data, x is the n-vector with the proportion of each end-member, and d is the m-vector constituted of the data measured on the commingled oil. Because the system of linear equations is overdetermined (more equations than unknowns, i.e. $m>n$), different methods based on least-square method can be utilized to solve this system. According to one embodiment, singular value decomposition gives the pseudo-inverse of the matrix G. This method aims to find 3 square matrices U, S and V with $G=U \cdot S \cdot V^T$ (where $G^T$ is G transposed), so that $x=V \cdot S^{-1} \cdot U^T \cdot d$. According to another embodiment, the normal equations: (1) $\Leftrightarrow G^T \cdot G \cdot x = G^T d \Leftrightarrow x = (G^T \cdot G)^{-1} \cdot G^T d$ are inverted. According to some embodiments, the use of constraints (for example, non-negative, max=100%, sum of the contributions=100%) has been found to lead to a more reliable result.

Figure 2B:
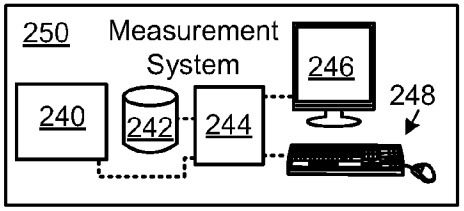
FIGS. 2*a*-2*c* show various components of and operational environments in which systems and methods for real-time wellsite production allocation, according to some embodiments.
Figure 2C:
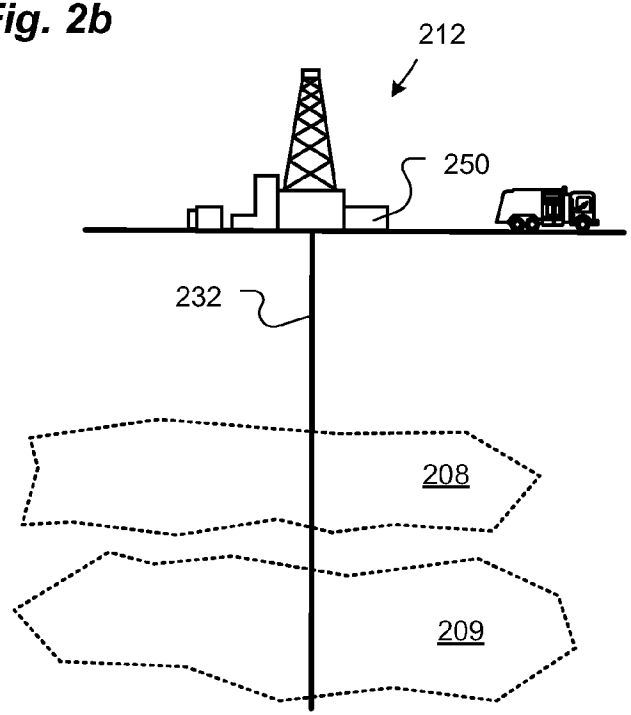
Figure 2A:
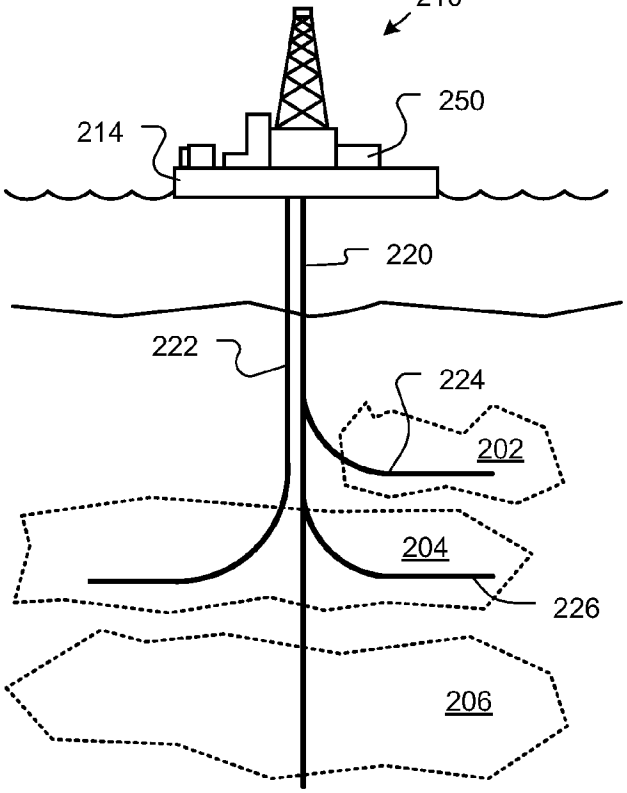

FIGS. 2*a*-2*c* show various components of and operational environments in which systems and methods for real-time wellsite production allocation, according to some embodiments. FIG. 2*a* shows a marine wellsite 210 including a marine platform 214 that receives produced fluid from two wells 220 and 222. Well 220 includes multiple lateral sections 224 and 226 that drain fluid from two production zones 202 and 204 respectively. Well 220 also drains fluid from production zone 206. Well 222 drains a different area of production zone 204. Wellsite 210 includes an in-situ measurement system 250 used to make spectroscopic measurements of fluid produced from wells 220 and 222 and calculate, in real time, production allocations for the produced fluids. End member samples are also preferably collected which can be used in the allocation estimates. According to some embodiments, the end members are sampled using known methods such as shutting in the well, or by downhole sampling.

FIG. 2*b* is a schematic of an in-situ measurement system 250 used to make measurements of the produced fluid at the wellsite and to calculate, in real time, a production allocation, according to some embodiments. Measurement system 250 includes a central processing unit 244, storage system 242, spectroscopic measurement module 240, a user display 246 and a user input system 248. According to some embodiments, spectroscopic measurement module 240 includes one or more of the following spectroscopy systems: ultraviolet-visible-near infared (UV-Vis-NIR) spectroscopy, X-ray fluorescence spectroscopy, Raman spectroscopy, NMR spectroscopy, and terahertz spectroscopy.

FIG. 2*c* shows a land-based wellsite 212 that receives produced fluid from a well 232. Well 232 drains fluid from two production zones 208 and 209. Wellsite 212 includes an in-situ measurement system 250 used to make spectroscopic measurements of fluid produced from well 232 and calculate, in real time, production allocations for the produced fluid.

Further detail on using Ultraviolet (UV)-Visible-Near Infrared (NIR) Spectroscopy will now be provided, according to some embodiments. This spectroscopy technique has been proven highly reliable in characterizing hydrocarbon fluids in oilfield settings. For example, optical spectroscopy methods are used in connection with the current Modular Dynamic Tester (MDT) tools from Schlumberger. Absorbance measurements on both commingled and pure end member oil samples (which can be collected either from well head or downhole sampling). The method relies on the fact that the NIR spectra of the commingled oils are a linear combination of the NIR spectra of the end-member. So, having the spectra of the end-member and the commingled oils allow to calculate easily the contribution of each end-member in the commingled production using a least-square method, singular value decomposition or a minimization process.

Figure 3:
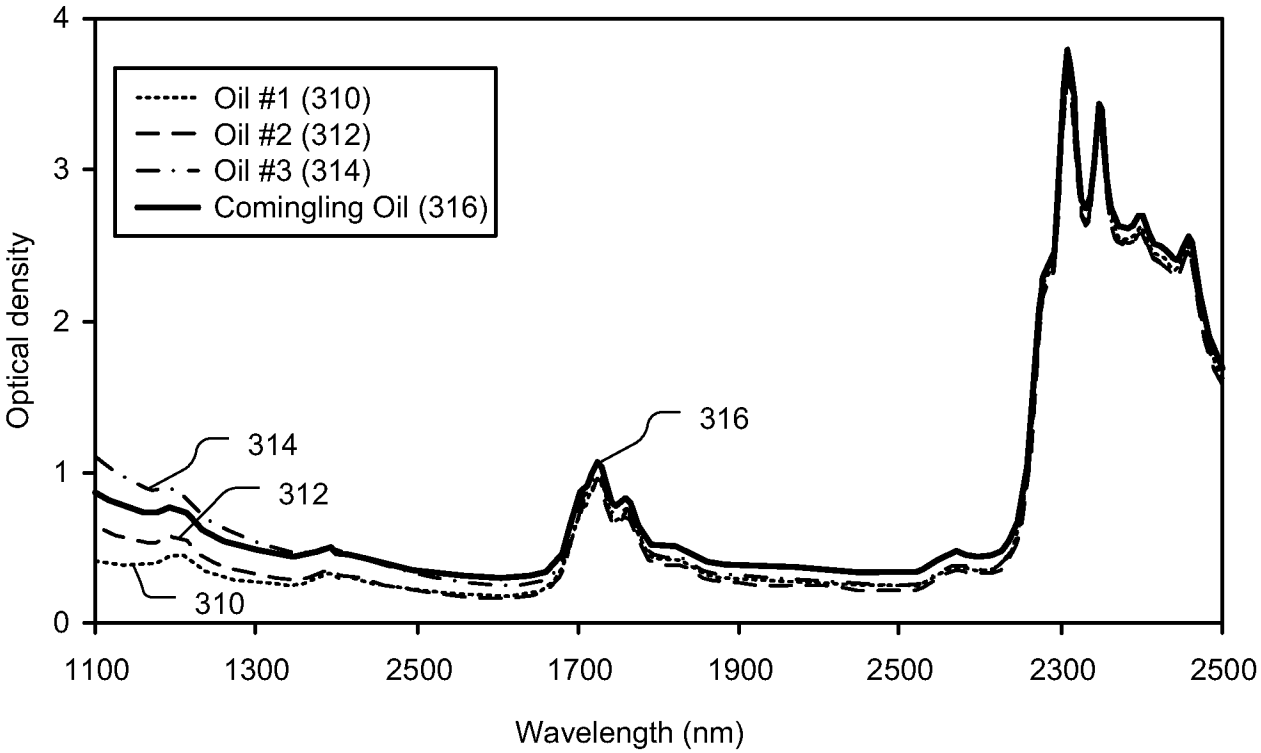
FIG. 3 shows an example of optical spectra from three end-member oils and an associated commingled oil.

FIG. 3 shows an example of optical spectra from three end-member oils and an associated commingled oil. The spectra of the three end-member oils, Oil#1, Oil#2 and Oil#3 are shown with traces 310, 312 and 314 respectively. The spectra of the associated commingled oil is shown with trace 316. As can be seen from FIG. 3, the spectra of the mixture fits between the three end-members' spectra. It has been found that results from the calculation using the whole spectra without the derivative gives an accurate result. For example, an allocation of 9.7 vol % of Oil#1, 60.4 vol % of Oil#2 and 29.9 vol % of Oil#3 was calculated using a least squares method, where the actual proportions where 10 vol %, 60 vol % and 30 vol %, respectively.

According to some embodiments, the techniques described in further detail below with respect to FIGS. 4-7 can also be used as an input to the process and replace the NIR spectra. According to some embodiments, if several spectroscopic techniques are available, the differentiation step of the process can also be used to determine the best analytical procedure to use depending on practical and economical aspects (differentiation of the oils but also applicability, accuracy, price, availability). Depending on the signal or the data used, the correction step may involve different techniques to align the signal, remove the baseline or any offset.

Figure 4:
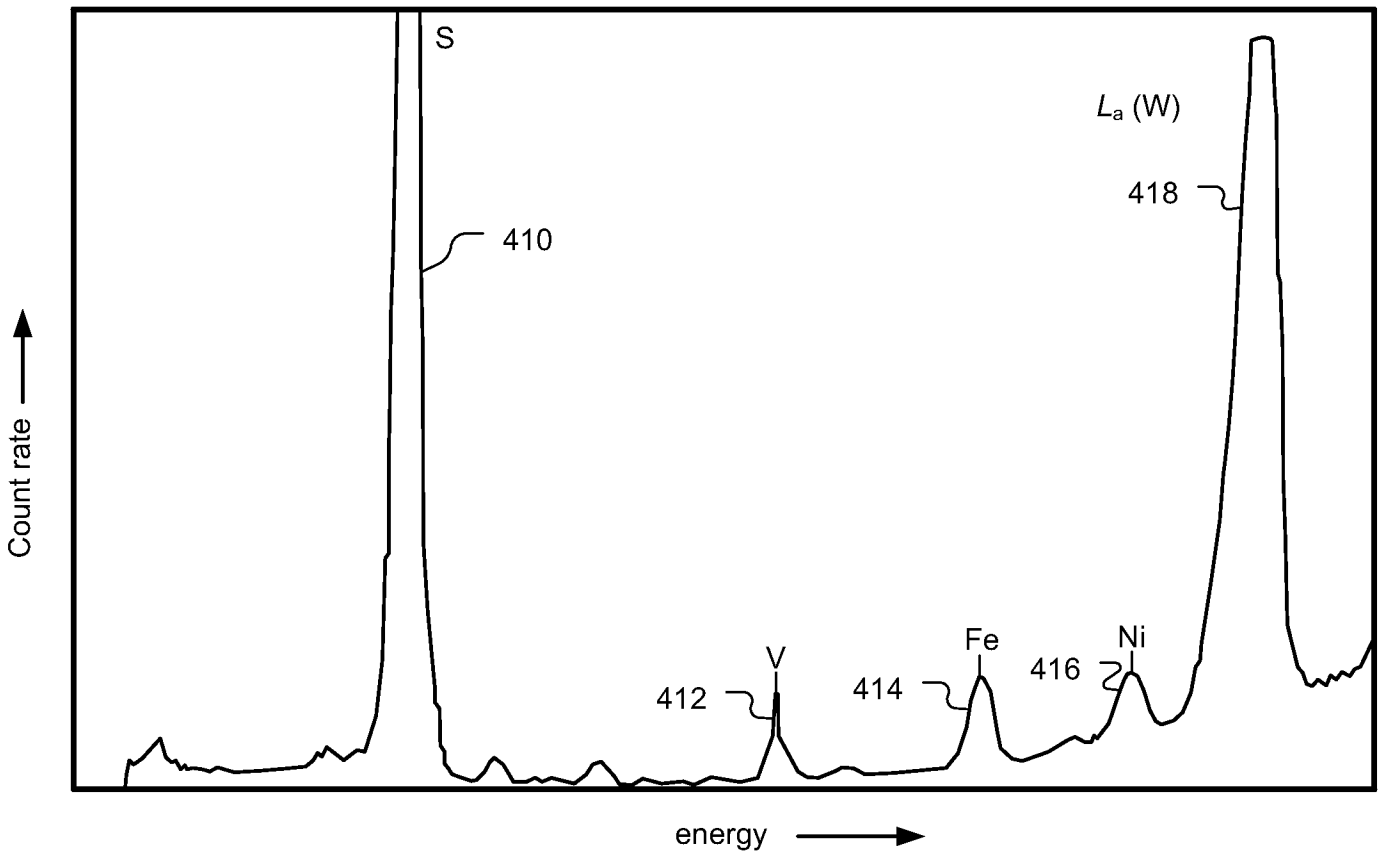
FIG. 4 shows a typical result of X-ray fluorescence spectroscopy analysis of an example oil, according to some embodiments.

According to some embodiments X-ray fluorescence spectroscopy is used for making in-situ wellsite measurements on which real-time wellsite production allocation is based. X-ray fluorescence spectroscopy (XRF) is a widely used technique for nondestructive analysis of bulk samples. XRF can be used to rapidly identify most elements with an atomic number equal to or greater than Sodium. A crude oil usually contains Sulfide, Vanadium, Iron and Nickel in molecules. According to some embodiments, in situ wellsite XRF measurements are used to calculate fractions of elements such as Sulfide, Vanadium, Iron and Nickel. The fractions are then used for a production allocation. FIG. 4 shows a typical result of X-ray fluorescence spectroscopy analysis of an example oil, according to some embodiments. The XRF trace shows spectral lines 410, 412, 414, 416 and 418 for Sulfur, Vanadium, Iron, Nickel, and Tungsten respectively. For further detail on the traces shown in FIG. 4, see N. Ojeda, E. D. Greaves, J. Alvarado and L. Sajo-Bohus, Determination of V, Fe, Ni and S in Petroleum Crude Oil by Total Reflection X-ray Fluorescence, Spectrochimica Acta Vol 48B No. 2, pp 247-253 1993, and Energy Dispersive X-ray Spectroscopy (EDS), both of which are incorporated by reference herein. According to some embodiments, the XRF analysis is carried out in a similar manner to known GC data analysis techniques for variations on specific compound content. According to some embodiments, a field portable energy-dispersive x-ray analyzer is used due its relatively simple design and the ability to used miniature x-ray tubes or gamma sources.

Figure 5:
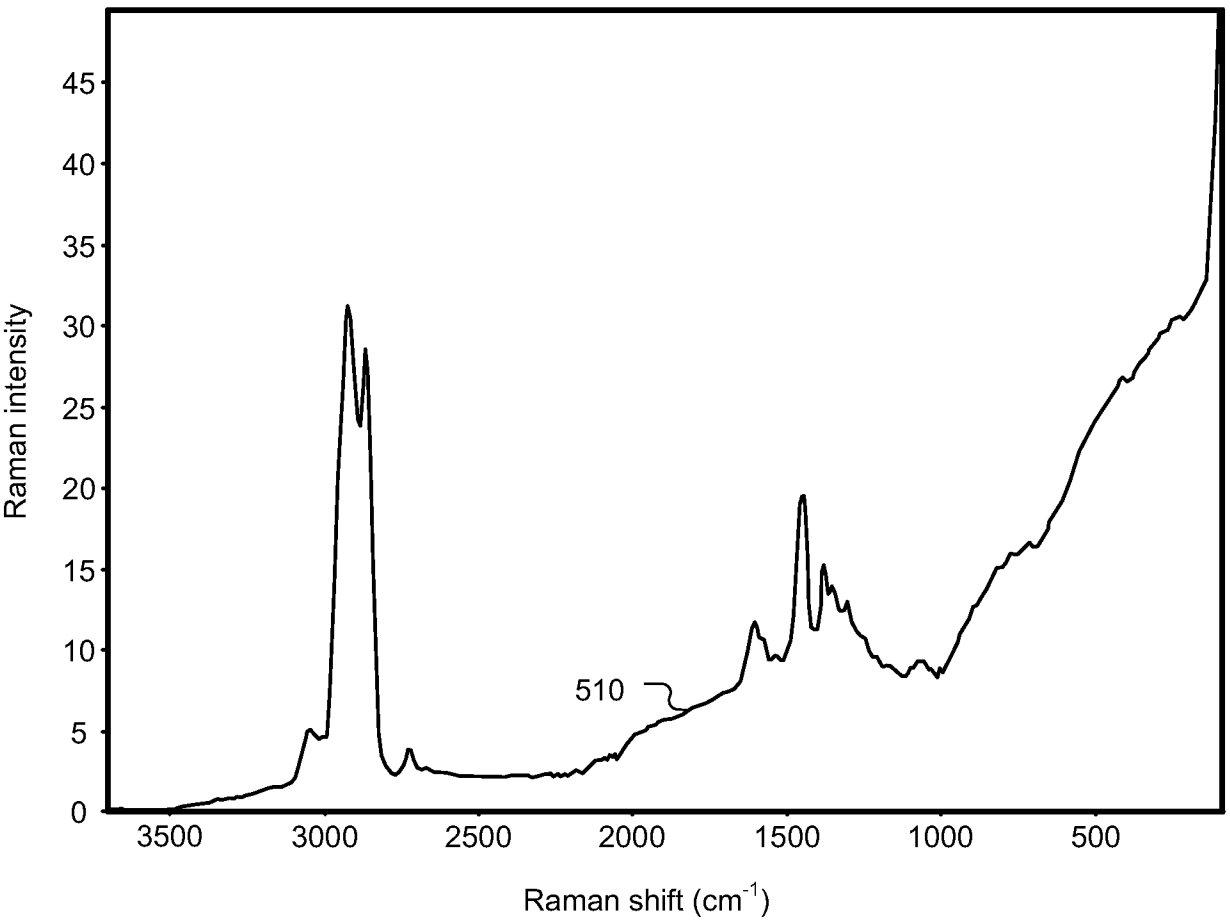
FIG. 5 is a plot showing Raman spectra for a light hydrocarbon sample.

According to some embodiments Raman spectroscopy is used for making in-situ wellsite measurements on which real-time wellsite production allocation based. Raman spectroscopy is commonly used in chemistry, since vibrational information is specific for the chemical bonds in molecules. It therefore provides a fingerprint by which the molecule can be identified. FIG. 5 is a plot showing Raman spectra for a light hydrocarbon sample. Plot 510 shows Raman data for a hydrocarbon sample. Similar to UV-Vis-NIR data, spectral features are unique for different oil samples and are used for back allocation, according to some embodiments. According to some embodiments, Raman microspectroscopy is used for in situ wellsite analysis for allocation. Raman spectroscopy offers some advantages for microscopic analysis. Since it is a scattering technique, specimens do not need to be fixed or sectioned.

Figure 6:
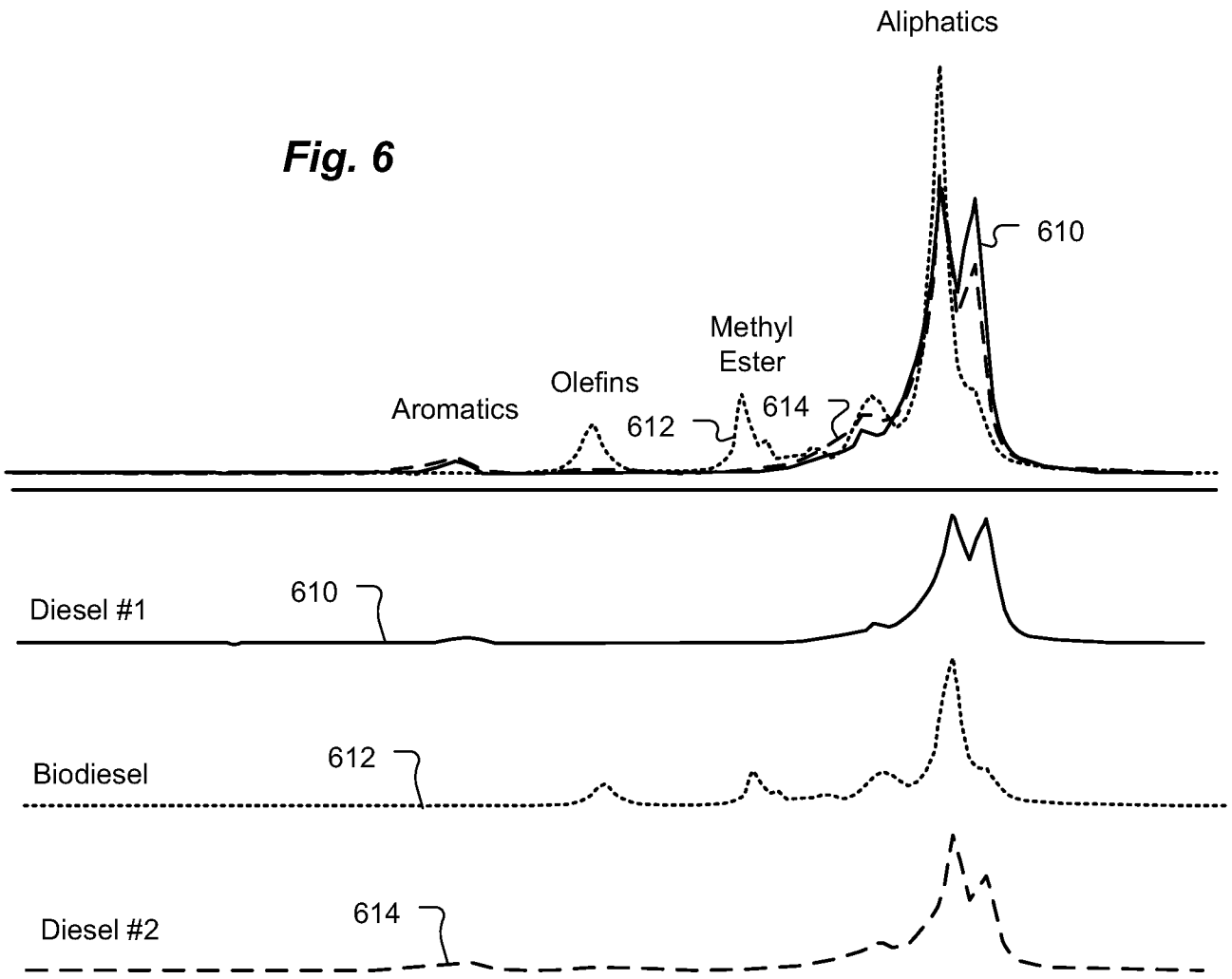
FIG. 6 shows NMR shift prints for different oil samples, according to some embodiments.

According to some embodiments nuclear magnetic resonance (NMR) chemical shift analysis is used for making in-situ wellsite measurements on which real-time wellsite production allocation based. The chemical shift is of great importance for NMR spectroscopy, a technique to explore molecular properties by looking at nuclear magnetic resonance phenomena. Nuclear magnetic resonance spectroscopy analyzes the magnetic properties of certain atomic nuclei to determine different electronic local environments of hydrogen, carbon, or other atoms in an organic compound or other compound. This is used to help determine the structure of the compound. FIG. 6 shows NMR shift prints for different oil samples, according to some embodiments. 1H NMR spectra 610, 612 and 614 are shown for three different oil samples Diesel #1, Biodiesel and Diesel #2, respectively. The spectra are shown both separately and superimposed. Similar to the other analyses described here, according to some embodiments, in situ wellsite NMR chemical shift analysis is employed to calculate production allocation. For further detail on NMR spectroscopy, see: Oliviera et, Talanta 69 (2006) 1278-1284 and Gnothe, J. Am. Oil Chem. Soc 78, 1025-1028, 2001, which is incorporated herein by reference.

Figure 7:
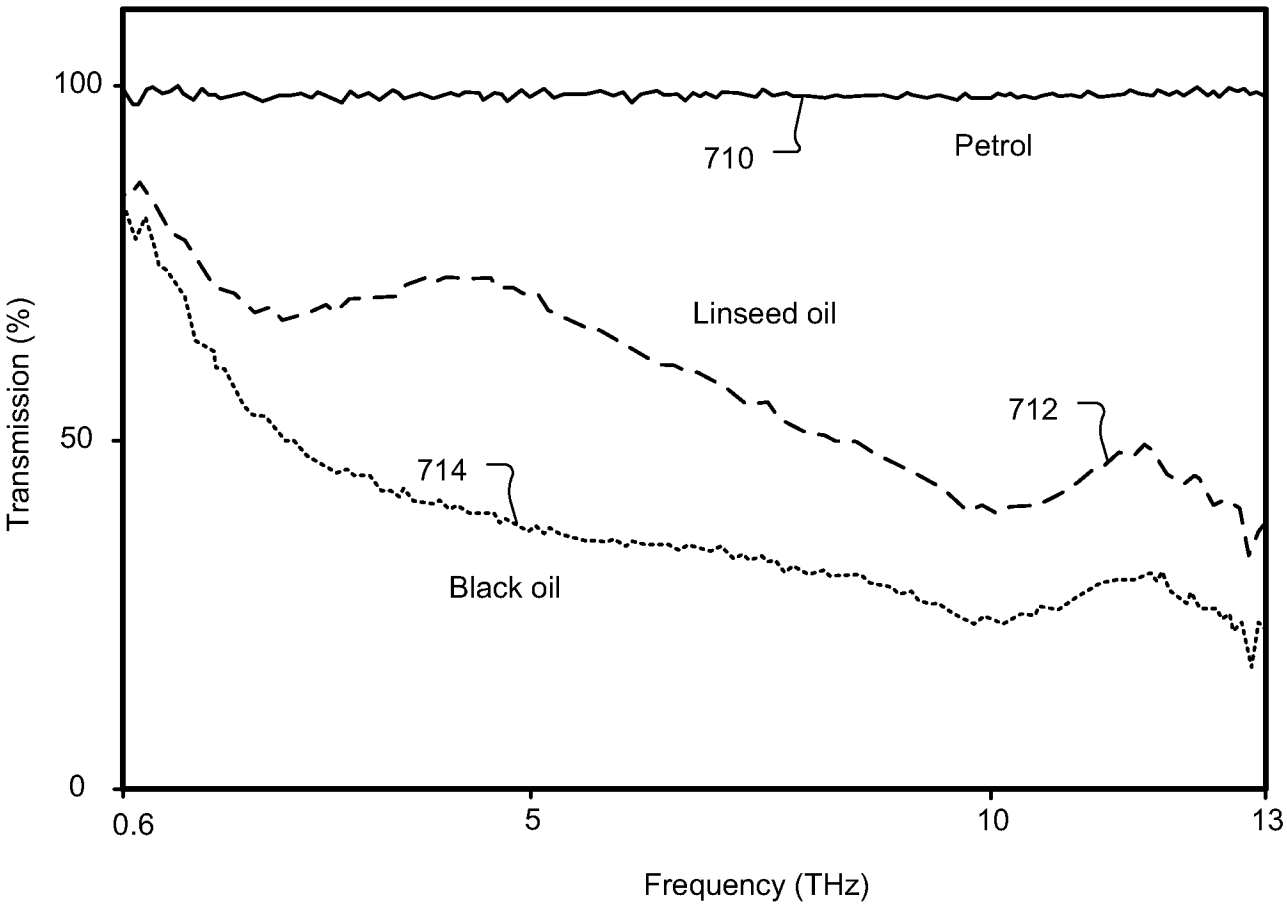
FIG. 7 shows examples of Terahertz Domain Spectra.

According to some embodiments terahertz spectroscopy is used for making in-situ wellsite measurements on which real-time wellsite production allocation based. Terahertz time-domain spectroscopy (THz-TDS) is a spectroscopic technique where a special generation and detection scheme is used to probe material properties with short pulses of terahertz radiation. The generation and detection scheme is sensitive to the sample material's effect on both the amplitude and the phase of the terahertz radiation. In this respect, the technique can provide more information than conventional Fourier-transform spectroscopy that is only sensitive to the amplitude. FIG. 7 shows examples of Terahertz Domain Spectra. In particular, traces 710, 712 and 714 are traces for petrol, linseed oil and black oil respectively. For further details of THz-TDS, see: Fukunaga K. Terahertz Spectral Database 2008—Journal of National Institute of Information and Communication Technology Vol. 55 No. 1, 2008, which is incorporated herein by reference.

Whereas many alterations and modifications of the present disclosure will no doubt become apparent to a person of ordinary skill in the art after having read the foregoing description, it is to be understood that the particular embodiments shown and described by way of illustration are in no way intended to be considered limiting. Further, the disclosure has been described with reference to particular preferred embodiments, but variations within the spirit and scope of the disclosure will occur to those skilled in the art. It is noted that the foregoing examples have been provided merely for the purpose of explanation and are in no way to be construed as limiting of the present disclosure. While the present disclosure has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present disclosure in its aspects. Although the present disclosure has been described herein with reference to particular means, materials and embodiments, the present disclosure is not intended to be limited to the particulars disclosed herein; rather, the present disclosure extends to all functionally equivalent structures, methods and uses, such as are within the scope of the appended claims.

What is claimed is:

1. A method for real-time wellsite production allocation analysis comprising:

obtaining, in-situ, an individual spectral analysis for each of a plurality of end member oils, each from a separate production zone via a plurality of spectroscopic measurements, wherein the plurality of spectroscopic measurements comprise at least two of electromagnetic absorption spectroscopic measurements, X-ray fluorescence spectroscopy measurements, electromagnetic scattering spectroscopic measurements, Raman spectroscopy measurements, NMR spectroscopy measurements, or terahertz time-domain spectroscopy measurements;

obtaining, in-situ, a commingled spectral analysis for a produced fluid that includes the plurality of end member oils in a commingled state via the plurality of in-situ spectroscopic measurements;

assuming a linear relationship between the individual spectral analyses and the commingled spectral analysis;

determining, in real time with a processing system, a fractional amount of each of the plurality of end member oils in the produced fluid, wherein the fractional amount is determined directly from the individual spectral analysis for each of the end member oils and the linear relationship; and wherein the processing system is programmed to determine which of the plurality of spectroscopic measurements to use in the determination of the fractional amount of each of the plurality of end member oils in the produced fluid.

2. A method according to claim 1 wherein obtaining a commingled spectral analysis comprises obtaining electromagnetic absorption spectroscopic measurements.

3. A method according to claim 2 wherein the electromagnetic absorption spectroscopic measurements include measurements of absorption of electromagnetic radiation having wavelengths in the range of ultraviolet, visible and/or infrared light.

4. A method according to claim 1 wherein obtaining a commingled spectral analysis comprises obtaining X-ray fluorescence spectroscopy measurements.

5. A method according to claim 1 wherein obtaining a commingled spectral analysis comprises obtaining electromagnetic scattering spectroscopic measurements.

6. A method according to claim 5 wherein the electromagnetic scattering spectroscopic measurements include Raman spectroscopy measurements.

7. A method according to claim 1 wherein obtaining a commingled spectral analysis comprises obtaining NMR spectroscopy measurements.

8. A method according to claim 1 wherein obtaining a commingled spectral analysis comprises obtaining terahertz time-domain spectroscopy measurements.

9. A method according to claim 1 wherein obtaining a commingled spectral analysis comprises employing a plurality of spectroscopic measurement techniques and determining which of the techniques will be used in the linear relationship.

10. A method according to claim 1 comprising applying data correction techniques to the individual spectral analyses, or to the commingled spectral analysis, or to both, wherein the data correction techniques comprise aligning signals, removing baseline, or removing offset, or a combination thereof.

11. A method according to claim 1 wherein determining a fractional amount comprises an error-minimization process.

12. A method according to claim 1 wherein determining a fractional amount comprises employing a constrained linear least-squares technique or a singular value decomposition technique, or both.

13. A method according to claim 1 wherein at least two of the plurality of end member oils are produced from different boreholes.

14. A method according to claim 1 wherein the plurality of end member oils are produced from the same borehole.

15. The method of claim 1, wherein assuming a linear relationship comprises assuming that the commingled spectral analysis is a linear combination of the individual spectral analyses.

16. The method of claim 1, wherein determining a fractional amount of each of the plurality of end member oils in the produced fluid comprises employing an over-determined system of linear equations.

17. The method of claim 1, wherein determining a fractional amount of each of the plurality of end member oils in the produced fluid comprises interpreting the individual spectral analyses, the commingled spectral analysis, or both, to select a differentiating part of a resultant signal.

18. The method of claim 1, wherein determining a fractional amount of each of the plurality of end member oils in the produced fluid comprises employing a principal component analysis.

19. A system for real-time wellsite production allocation analysis comprising:

a plurality of in-situ spectroscopic measurement systems employing different spectroscopic measurement techniques to obtain an individual spectral analysis for each of a plurality of end member oils, each from a separate production zone, and to obtain a commingled spectral analysis for a produced fluid that includes the plurality of end member oils in a commingled state, wherein the plurality of in-situ spectroscopic measurement systems are adapted to make at least two of electromagnetic absorption spectroscopic measurements, X-ray fluorescence spectroscopy measurements, electromagnetic scattering spectroscopic measurements, Raman spectroscopy measurements, NMR spectroscopy measurements, or terahertz time-domain spectroscopy measurements; and a processing system configured and programmed to determine, in real time, a fractional amount of each of the plurality of end member oils in the produced fluid, wherein the fractional amount is determined directly from the individual spectral analysis for each of the end member oils and a linear relationship assumed between the individual spectral analyses and the commingled spectral analysis, and the processing system is programmed to determine which of the plurality of in-situ spectroscopic measurement systems to use in the determination of the fractional amount of each of the plurality of end member oils in the produced fluid.

20. A system according to claim 19 wherein the absorption measurements include measurements of absorption of electromagnetic radiation having wavelengths in the range of ultraviolet, visible and/or infrared light.

21. A system according to claim 19 wherein the processing system is further programmed to apply data correction techniques to the individual spectral analyses, or to the commingled spectral analysis, or to both, wherein the data correction techniques comprise aligning signals, removing baseline, or removing offset, or a combination thereof.

22. A system according to claim 19 wherein the processing system is further programmed to employ a constrained linear least-squares technique, or a singular value decomposition technique, or a combination thereof.

23. A system according to claim 19 wherein at least two of the plurality of end member oils are produced from different boreholes.

24. A system according to claim 19 wherein at least two of the plurality of end member oils are produced from the same borehole.

* * * * *